US005957572A

United States Patent [19]

Wedekind et al.

[11] Patent Number: 5,957,572

[45] Date of Patent: Sep. 28, 1999

[54] REMODELER LIGHT FIXTURE SUPPORT STRUCTURE AND METHOD

[75] Inventors: Robert James Wedekind, Riverside, R.I.; Mark Owen Jones, South Dartmouth, Mass.; Graham Michael Rippel, South Easton, Mass.; Dennis Joseph Foley, Mattapoisett, Mass.

[73] Assignee: Lightolier, Fall River, Mass.

[21] Appl. No.: 08/884,006

[22] Filed: Jun. 27, 1997

[51] Int. Cl.[6] ..... F21S 1/06

[52] U.S. Cl. ..... 362/365; 362/368; 362/364; 362/147

[58] Field of Search ..... 362/365, 364, 362/368, 147

[56] References Cited

U.S. PATENT DOCUMENTS

| | | | |
|---|---|---|---|
| 3,130,949 | 4/1964 | Erhardt et al. | 362/365 |
| 4,450,512 | 5/1984 | Kristofek | 362/276 |
| 5,031,084 | 7/1991 | Russo et al. | 362/365 |
| 5,725,302 | 3/1998 | Sirkin | 362/365 |

*Primary Examiner*—Sandra O'Shea
*Assistant Examiner*—John A. Ward
*Attorney, Agent, or Firm*—Hopgood, Calimafde, Kalil & Judlowe LLP

[57] ABSTRACT

A method, system and apparatus for supporting a light fixture in an aperture formed in a planar member is disclosed. An aperture is first cut in the planar member at the point where the lighting fixture is to be installed and a light fixture support structure having at least two mounting straps positioned about the perimeter of the light fixture support structure for retaining the light fixture support structure in position in the aperture formed in the planar member is positioned in the aperture by an installer. The light fixture support structure mounting straps are then positioned contiguous with the inner surface of the planar member and are manipulated such that the light fixture support structure is maintained in position in the aperture. The light fixture support structure includes a perimeter member having a wall portion and a lip portion and having at least two slots formed at the junction of the wall and the lip and at least two mounting straps positioned in the at least two slots for retaining the light fixture support structure in position in the aperture formed in the planar member. The mounting strap including a hook member at one end and a v shaped two leg member at the other end with each of the legs having a flange member for engaging the surface of the planar member. Methods of installing remodeler light fixtures in a planar member are also disclosed.

43 Claims, 7 Drawing Sheets

REMODELER LIGHT FIXTURE SUPPORT STRUCTURE AND METHOD

BACKGROUND OF THE INVENTION

The present invention relates in general to remodeler light fixtures or other devices installed in the walls and/or ceilings of buildings having support structures and methods of installing the support structures. More particularly, it relates to simple and reliable remodeler light fixture support structures and methods of installing same in areas having limited, if any, access from above or behind the light fixture. Even more particularly, it relates to light fixture support structures that may be attached without tools and which meet Underwriters Laboratory (UL) standards and building codes.

Various methods, systems and apparatuses for installing lighting fixtures in existing construction as opposed to new construction have been developed and practiced by the lighting industry. Examples of prior systems and apparatuses for installing lighting fixtures in existing construction in the field of the present invention include those described in patents of the assignee of the present application: U.S. Pat. Nos. 5,031,084; 5,317,493; 5,222,800; 5,374,812; 5,452,816 and 4,646,212. Additionally, U.S. Pat. No. 2,454,119 is related to the subject matter of the present application. These patents are representative of patents directed to the subject matter of the present application.

The prior art constructions and methods all have disadvantages in that they have a plurality of parts requiring assembly to the structure often requiring the installer to use tools, including simple hand tools, during installation. Further, with the prior art constructions, installers are unable to separate the mechanical portion from the electrical portion of the installation, often requiring a qualified electrician to perform the entire installation rather than allowing a lesser skilled worker to install the mechanical portion and an electrician to install the electrical portion at a later time. These prior remodelers often comprise multiple unattached components and, thus, there is the possibility that unattached structural components might become separated from the fixture during the installation. When the unattached structural components fall during installation in a ceiling, the installer has to go down the ladder to retrieve the fallen components. Thus, the prior remodelers are more complicated than just a simple unitary part that the installer can hold in one hand while climbing a ladder.

These prior remodeler fixtures and methods are somewhat inadequate when used in "roughin" sections which allow contractors to do the mechanical and the electrical work required to finish the installation of a new light fixture in an existing construction. In the installation method typically used in remodeling applications, the trim installation, or the installation of the light fixture itself, is usually accomplished after painting and other mechanical alterations are made in the space. The trim merely finishes the installation of the light fixture.

Another unsolved problem experienced by the prior remodelers relates to the uneven or non homogeneous thickness of the planar surface surrounding the cutout where the lighting fixture was housed. Often the planar surface or the ceiling has insufficient strength or structural integrity to support the light fixture without the support structure penetrating the ceiling or, in the worst case, cracking the ceiling. When this occurs, the ceiling is unable to properly support the lighting fixture. This is especially true for suspended ceiling tile, when, for example, the lighting fixture includes integral electronic or magnetic ballasting or transformers with the total weight being up to about four or five pounds.

While suspended ceiling is not the typical remodeler installation, some architects have requested a remodeler light fixture product for use with suspended ceiling tiles. Ideally, the remodeler fixture would tie into the structural members or T bars that support the tile. Some tiles for acoustic applications can be about two inches thick and, as such, have structural integrity unto themselves. Yet, there is presently no known cost effective remodeler light fixture support structure available that could be safely installed to meet UL and code requirements and be sufficiently supported by suspended ceiling tiles.

Another problem with prior round remodelers relates to rotation of the support structure. Prior round remodeler support structures are susceptible to rotating in the planar surface once human force is applied. If the support structure rotates in the planer surface, such rotation complicates the installation and removal of protective and aesthetic enclosures typically used in food service areas and showers, etc.

Yet another problem with the prior remodelers relates to the need to accurately and securely position the junction box on the surface of the planar member relative to the trim positioned in the aperture. If the junction box is positioned too close to the trim or if the junction box is left to be freely repositioned on the surface of the planar member without being located at a fixed distance from the trim, the junction box could become repositioned to touch the trim causing the junction box to become overheated and malfunction. Therefore, the junction box must be precisely positioned relative to the trim so that a thermal probe, for detecting properly placed insulation, is installed at the required height off the surface of the planar member or ceiling. More importantly, the junction box must be accurately and securely positioned on the surface of the planar member relative to the trim positioned in the aperture at a location that prevents the junction box from overheating. Prior remodelers are not believed to have reliable means for repeatedly, consistently and predictably positioning the junction box.

SUMMARY OF THE INVENTION

It is an object of the present invention to provide an improved remodeler light fixture support structure for installation in planar members.

Another object of the present invention is to provide an improved system, apparatus and method for a remodeler light fixture support structure for installation in planar members that retains the light fixture support structure in position in the planar surface by clamping the planar surface between the lip portion of the perimeter member and a retaining means.

Still another object of the present invention is to provide means for installing the electrical and the mechanical elements of the remodeler light fixture at different times and by installers having different levels of skill.

A further object of the present invention is to provide means for sandwiching a planar member of variable thickness without penetrating the surface of the planar member.

Another object of the present invention is to provide improved methods, systems and apparatuses for securing the support structure to the surface of the planar member.

Still another object of the present invention is to provide means for consistently and repeatedly positioning a junction box relative to the aperture.

A further object of the present invention is to provide means for marking the position on the planar surface where the aperture is to be cut to guide the installer in cutting the aperture in the planar member.

A still further object of the present invention is to provide a support structure that can be effectively installed in planar members made of relatively brittle material.

Another object of the present invention is to provide an improved system, apparatus and method for a remodeler light fixture support structure for installation in planar members that prevents the support structure from rotating in the aperture in the planar surface when rotational force is applied to the support structure.

In accordance with the present invention, one representative system for supporting a light fixture in an aperture formed in a planar member having a certain thickness comprises: a light fixture support structure including a perimeter member having a wall portion and a lip portion, the lip portion protruding outwardly from the wall portion; and retaining means, operatively connected to the perimeter member, for retaining the light fixture support structure in position in the planar member by clamping the planar member between the lip portion of the perimeter member and the retaining means.

A tab or tongue, operatively connected to a junction box and operatively connectable to the support structure, is provided for accurately, repeatedly locating the junction box relative to the aperture and to facilitate compliance with UL requirements and codes.

Moreover, in accordance with the methods, systems and apparatuses of the present invention, we have provided a mounting strap for securing a light fixture support structure to an aperture formed in a planar member, the mounting strap comprising: an elongated, planar member having a hook portion at one end and a v shaped two leg member at the other end.

In accordance with one aspect of the present invention, we have provided a junction box for use with a remodeler support structure installed in a plurality of possible apertures formed in existing construction, the junction box comprising: two side walls; a top wall; a front wall and a rear wall, the rear wall including means for housing a thermal probe; and a planar base plate having a top and a bottom surface and having a front portion and a rear portion, the planar base plate being operatively connected to the walls, the front portion extending beyond the front wall for a predetermined distance, the end of the front portion most remote from the front wall having at least two tips, one on each side of the end of the front portion, for interacting with the aperture such that the junction box is repeatedly and consistently positioned at the predetermined distance from any one of a plurality of apertures In accordance with the present invention, one representative method for installing a light fixture in a planar member comprises the steps of: cutting an aperture in the planar member having an inner and an outer surface at the point where the lighting fixture is to be installed; providing a light fixture support structure having a perimeter and a lip having an inner and an outer surface; providing at least two means, operatively positioned about the perimeter of the light fixture support structure, for retaining the light fixture support structure in position in the aperture formed in the planar member; positioning the light fixture support structure in the aperture; positioning the at least two light fixture support structure retaining means contiguous with the inner surface of the planar member; manipulating the light fixture support structure retaining means such that the light fixture support structure is maintained in position in the aperture by clamping the planar member between the lip of the light fixture support structure and the retaining means.

Other objectives and advantages of the present application will become apparent from the following description, the accompanying drawings and the appended claims.

BRIEF DESCRIPTION OF THE DRAWINGS

FIG. 12 illustrates the support structure of the present invention being installed in a cut hole or aperture in a planar member or ceiling;

FIG. 13 illustrates the installer moving the mounting strap 40 into contact with the inner surface of the planar member to clamp the planar member (ceiling) between the mounting strap and the lip of the planar perimeter member of the support structure;

FIG. 14 illustrates the mounting strap of FIG. 13 after the installer has properly positioned the mounting strap;

FIG. 15 illustrates the connection of the wiring to a junction box;

FIG. 16 illustrates the connection of the junction box tab with the perimeter member of the support structure;

FIG. 17 illustrates the position of the junction box relative the planar member (ceiling) once connected to the perimeter member;

FIG. 18 illustrates the completed lighting fixture installed in the aperture according to the present invention.

DETAILED DESCRIPTION OF THE INVENTION

Figure 1:
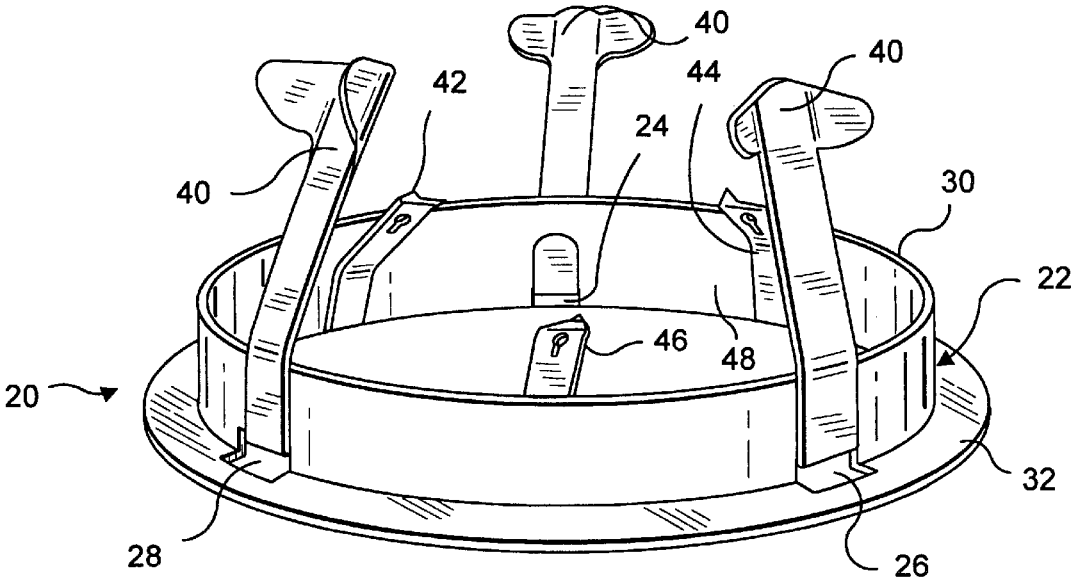
FIG. 1 is a perspective view illustrating a remodeler light fixture support structure according to the present invention.

In carrying out the present invention in preferred forms thereof, we have provided improved methods, systems and apparatuses for installing a light fixture in existing construction in a manner that significantly reduces installation time and facilitates flexible contractor scheduling in that the mechanical and the electrical portions of the installation can be readily accomplished at different times by different personnel. The methods, systems and apparatuses of the present invention are simple, versatile, flexible, low maintenance, cost effective, require no specialized tools and are space efficient. The methods, systems and apparatus of the present invention include unique combinations of elements and steps that facilitate the installation of a remodeler light fixture by using a support structure having clamp means operatively connected thereto.

FIGS. 1–18 illustrate a representative new remodeler light fixture support structure and new methods of installing the remodeler light fixture in the support structure. As shown in FIGS. 1–8, the remodeler light fixture support structure 20 includes a perimeter member 22 having at least two, and preferably three, slots 24, 26, 28 operatively formed therein. The perimeter member can be circular or of any other geometric shape which corresponds to the shape of a desired light fixture. Specifically, the perimeter member can be shaped as desired, such as, for example, square, rectangular, elliptical, pentagonal, etc.

As shown in FIGS. 1–5, the perimeter member comprises a wall portion 30 and a lip portion 32 (the lip portion may be continuous or segmented) formed to protrude outwardly from the wall portion 30 and, as illustrated, the perimeter member is circular and has the preferred three slots 24, 26, 28 formed therein spaced about one hundred twenty (120°) degrees apart. These slots 24, 26, 28 are for receiving a light fixture support structure retaining means or a mounting strap 40. The details of the mounting strap 40 will be described below.

As shown in FIG. 1, three representative trim springs 42, 44, 46 (three trim springs are presently preferred for the 1000 and 2000 series remodelers and four trim springs presently preferred for the 1100 series remodeler) are operatively positioned about one hundred twenty (120°) degrees apart around the interior periphery 48 of the perimeter member 22 for centering the trim or the lighting fixture once the trim 50 (see FIG. 18) is installed into the perimeter member 22. It should be understood that more trim springs or other supporting means could be used, such as, for example, four (4) trim springs positioned about ninety (90°) degrees apart (1100 series remodeler). In fact, any number of trim springs or other supporting means could be used as long as they support the trim 50 in accordance with known conventional standards.

The trim springs 42, 44, 46 are positioned on the inner periphery 48 of the perimeter member 22 such that the position of the trim springs 42, 44, 46 with respect to the trim 50 is constant regardless of the planar member 52 thickness. In other words, the distance from the lip portion 32 of the perimeter member 30 to the trim springs 42, 44, 46 is constant. If this distance were not constant, planar thickness would determine trim spring location. In that case, the thicker the planar material the farther away the trim springs would be located relative to the trim. If all trims were uniform along the side or vertical walls, this would not be a problem but the side walls of most trims are not uniform and actually curve inwardly thereby reducing the distance between the side walls.

Figure 3:
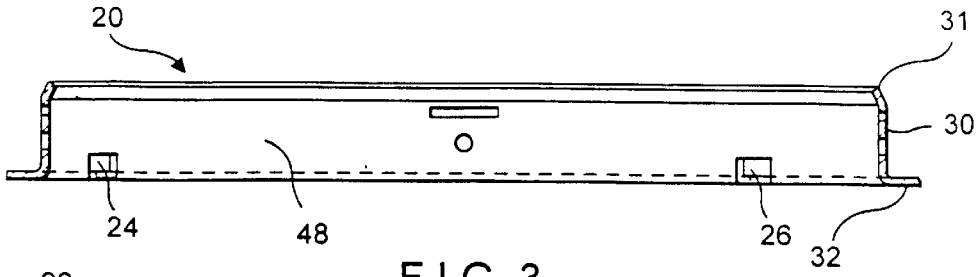
FIG. 3 is a sectional view of the perimeter member of FIG. 2 taken along line 3—3.
Figure 4:
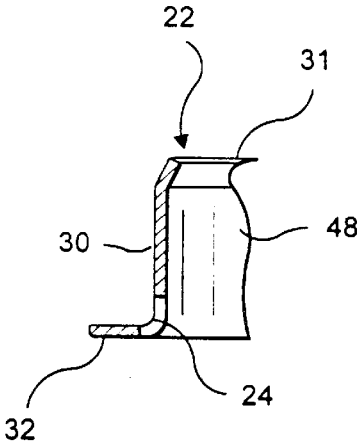
FIG. 4 is an enlarged sectional view of a slot used to hold a retaining member of the perimeter member of FIG. 1.

As shown in FIGS. 3 and 4, because the mounting straps 40 interact with the perimeter member 22 in a specific manner, the slots 24, 26, 28 are formed in perimeter member 22 at the junction between the wall portion 30 of the perimeter member 22 and the lip portion 32. The wall portion 30 is, presently preferably, about 0.75 inch high and has a tip 31 at one end which is, presently preferably, bent at about a fifteen (15°) degree angle toward the interior portion of the perimeter member 22. The lip portion 32 is formed to protrude outwardly from the wall portion 30. The lip portion 32 extends outwardly from the wall portion 30 at about a ninety degree (90°) angle therewith. The slots 24, 26, 28 for receiving the mounting straps 40 are positioned in the curved portion of the perimeter member 22 between the lip portion 32 and the wall portion 30 with the dimensions of the lip portion from the interior surface of the perimeter member 22 toward the end of the lip portion most remote from the wall portion 30 being about, presently preferred, 0.10 inch and the dimensions of the portion of the slot 24 from the surface of the lip portion 32 most remote from the angled tip 31 of the perimeter member 22 being about 0.15 inch toward the angled tip 31. The width of the slots 24, 26, 28 is, presently preferred, about 0.41 inch.

Figure 5:
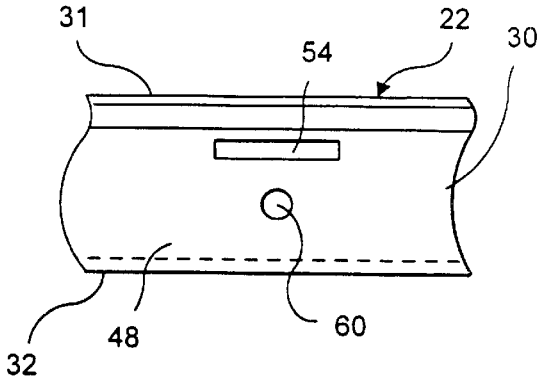
FIG. 5 is an enlarged view of the portion of the perimeter member where a spring member for holding the trim is attached to the perimeter member.

As shown in FIG. 5, one additional slot 54 and related aperture 60 for operatively positioning the trim springs 42, 44, 46 (see FIG. 1) are formed in the perimeter member 22 with the circular aperture being located about 0.281 inch from the lower surface of the lip portion 32. The about 0.093 inch by about 0.510 inch slot 54 is positioned about 0.220 inch above the center radius of the 0.136 radius aperture 60 toward the angled tip 31, of the wall portion 30 of the perimeter member 22.

It should be understood that all part dimensions are for illustrative purposes and that those skilled in the art could easily determine appropriate dimensions for a plurality of possible support structures to meet a plurality of different application requirements.

Figure 2:
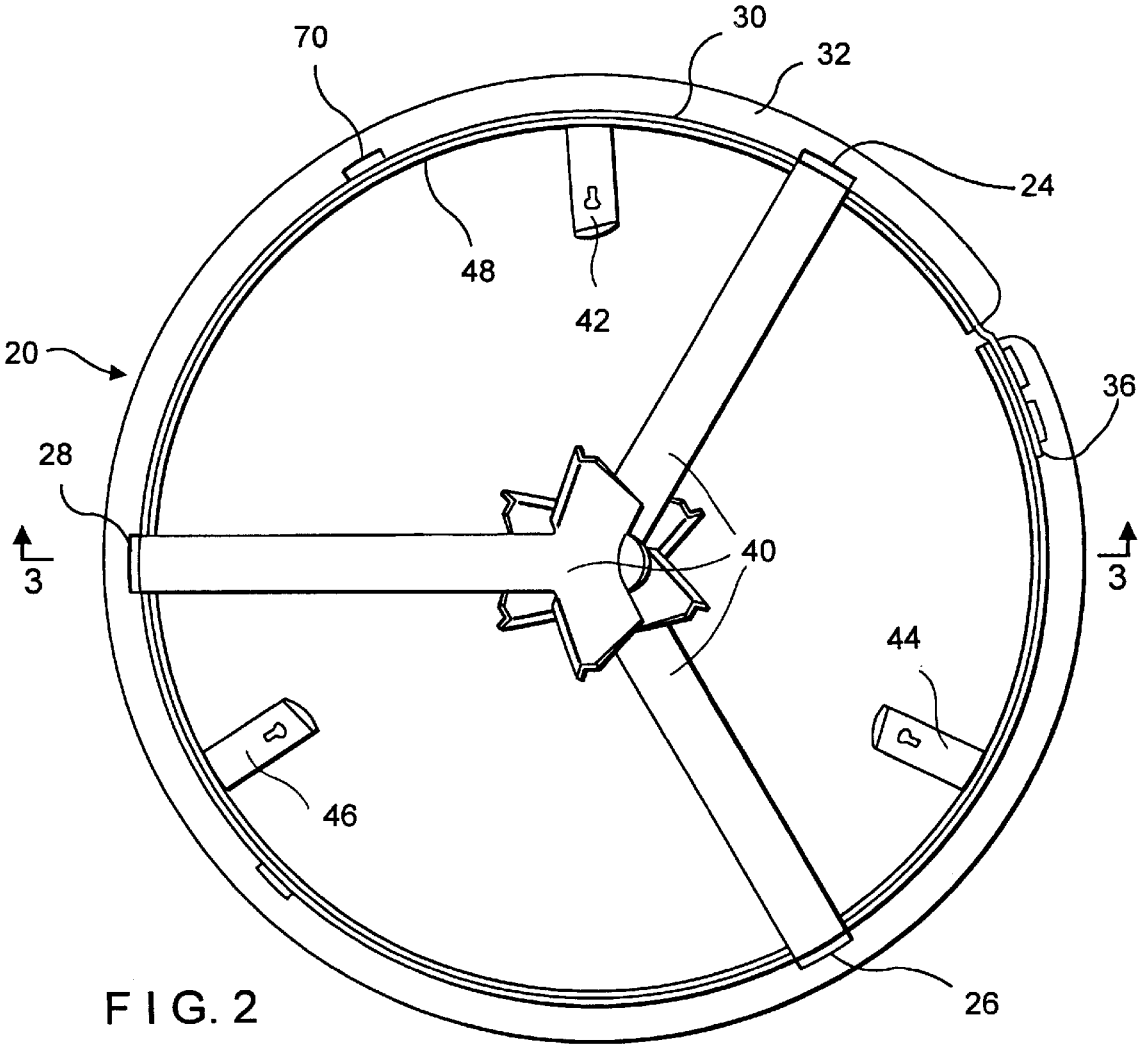
FIG. 2 is a top view illustrating the perimeter member of the support structure of FIG. 1.

As illustrated in FIGS. 2 and 3, the perimeter member 22, is conventionally formed from about 0.032 inch thick C-1010 or C-1008 hot dipped galvanized G-60 minimum spangle, matte finish commercial quality metal. The perimeter member 22 can be either formed as a continuous member or formed by rolling such that there is an overlap connecting portion 36. The overlap 36 between ends of the perimeter member 22, is presently preferred, a minimum of about one (1) inch. The overlapping portion 36 is operatively connected in a conventional way such as, for example, by interlocking one overlapping thickness of the material into the other by a patented process known as "TOG-L-LOK." Alternative connecting methods include, but are not limited to, welding, riveting, using a tab and slot connection, adhesive, nuts and blots, screws, etc. When using three mounting straps 40 and four trim springs, the minimum angle between a mounting strap slot and a slot for the trim spring is presently preferably about thirty (30°) degrees.

Figure 12:
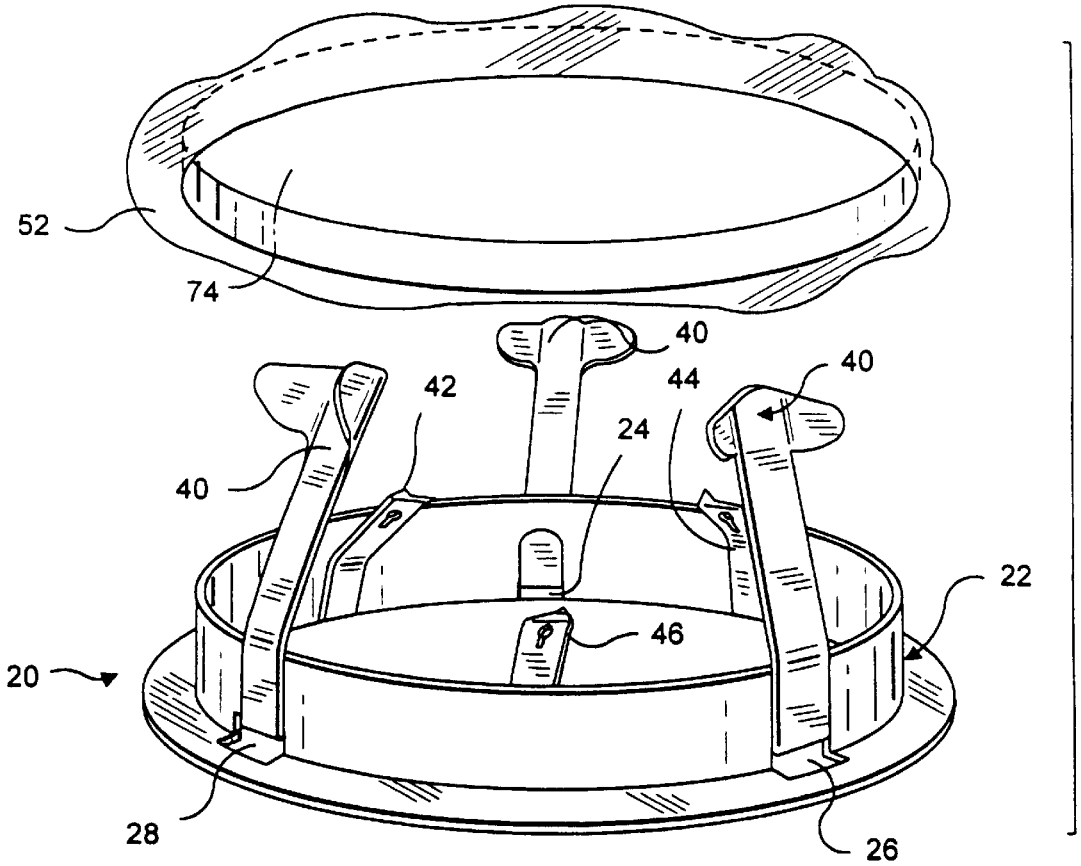
FIGS. 12 through 18 illustrate a sequence in a method according to the present invention.
Figure 16:
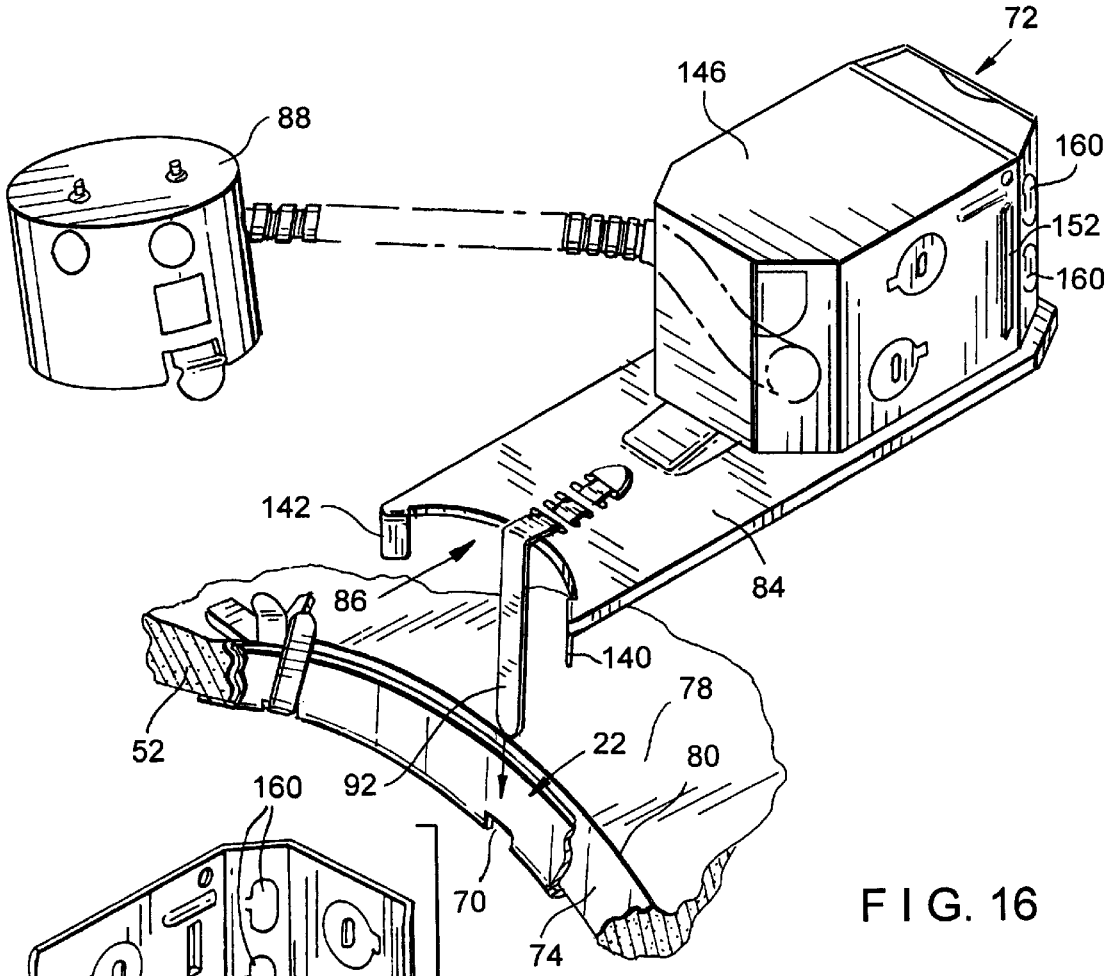

As shown in FIGS. 2 and 16, a single slot 70, relatively smaller than the mounting strap slots 24, 26, 28, is also operatively formed in the perimeter member 22. This smaller slot 70 facilitates the accurate assembly of the support structure 20 at the factory and is used for securing a junction box 72 (as will be described later) in position proximal an aperture 74 in a planar member 52. The position of the junction box 72 relative to the aperture 74 must be accurate so that a thermal probe 76, for detecting properly placed installation (not shown), is automatically and repeatedly installed at the required height off the ceiling or planar member 52 (FIG. 12). The junction box 72 must be accurately and securely positioned on the surface 78 of the planar member 52 relative to the trim 50 positioned in the aperture 74 such that the junction box 72 is prevented from overheating. In other words, the junction box 72 must be reliably installed at a constant, predictable distance from the edge 80 of the aperture 74 in order to prevent junction box 72 malfunctions. Thus, it is important to repeatedly, consistently and predictably position the junction box 72 so that when tested, all requirements for Underwriters Laboratories (UL) and building codes are met.

An important component of the junction box 72 is a base plate 84 having a lip 86 for positioning the junction box 72 relative to the aperture 74 in the planar member 52 regardless of the size of the standard light fixture aperture 74 that is cut. The length of the base plate 84 should be sufficiently long to properly position the thermal probe 76 relative to the installed trim 50. A socket 88 is conventionally operatively connected to the junction box 72.

Figure 11:
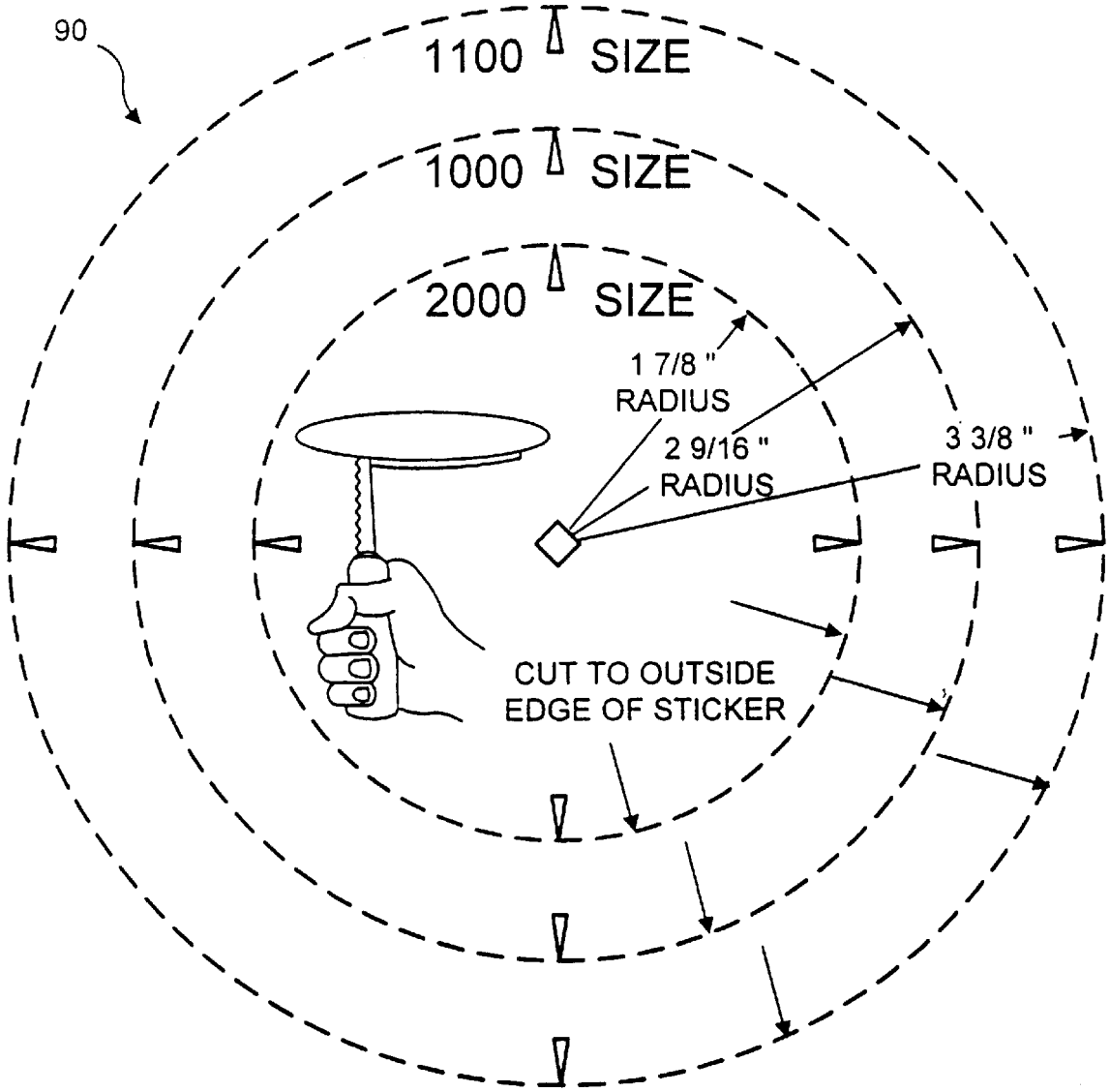
FIG. 11 is a plan view of a template usable with the present invention.

In an effort to assist the installer of the remodeler lighting fixture, the installation system includes a template 90 having the three standard sizes for remodeler lighting fixtures depicted thereon. Specifically, as illustrated in FIG. 11, the template 90 includes, as a minimum, indications for where the lighting fixture installer should cut the planar member 52 to install the remodeler lighting fixture. Specifically, size 2,000, 1,000 and size 1,100 lighting fixtures having a radius of 1⅞th inch, 2⁹⁄₁₆th inches and 3⅜th inches respectively are depicted on the template 90. The template 90 includes detailed instructions for the installer concerning the size aperture 74 or hole to cut in the planar member 52 for each specific size lighting fixture.

Figure 6:
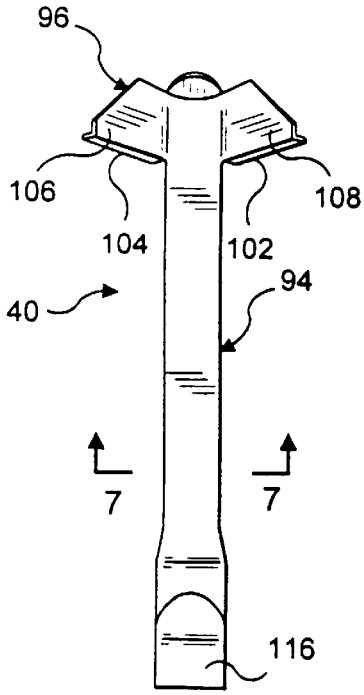
FIG. 6 is a perspective view of a retaining member according to the present invention.
Figure 7:
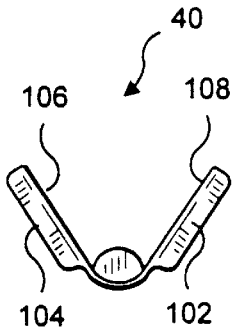
FIG. 7 is a view of the double winged end of the retaining member of FIG. 6 taken along line 7—7.
Figure 8:
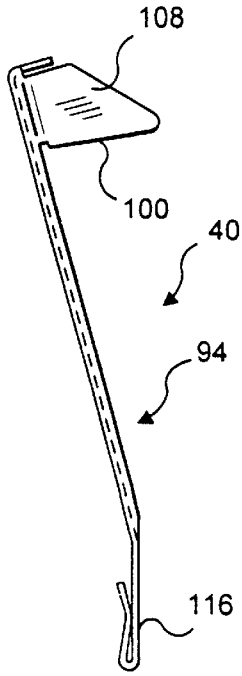
FIG. 8 is a side view of the retaining member of FIG. 6.
Figure 9:
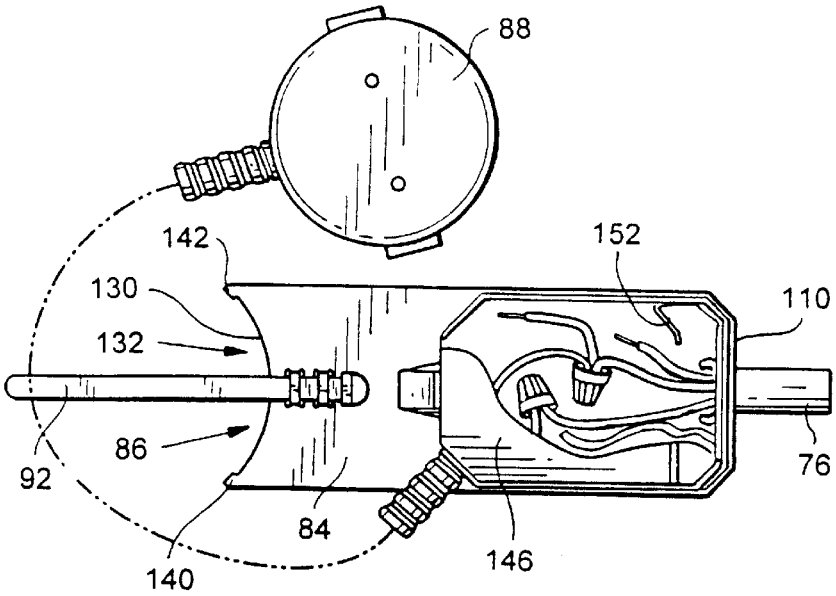
FIG. 9 is a top view of the junction box and socket according to the present invention.
Figure 10:
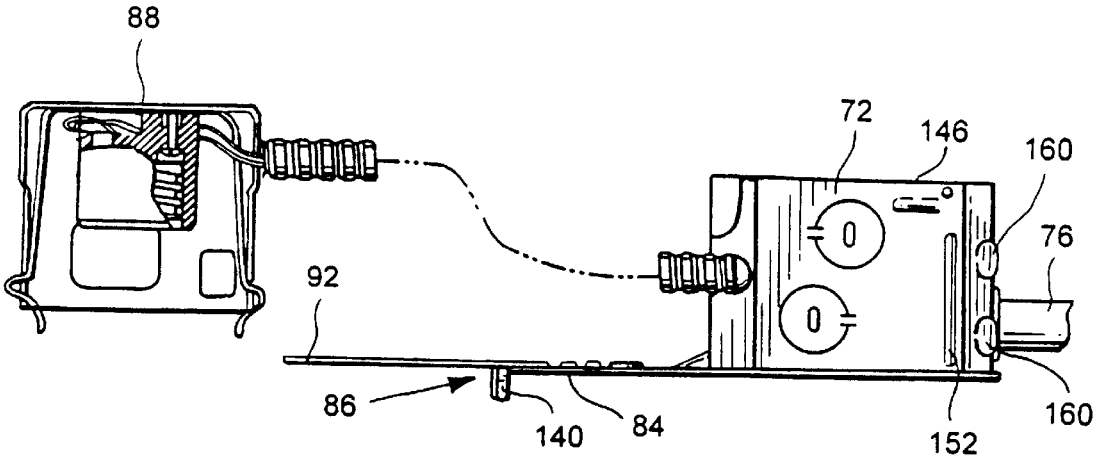
FIG. 10 is a side view of the junction box of FIG. 9.

As specifically shown in FIGS. 6–8, the mounting strap 40, as used in the support structure 20 and methods of the present invention, is, presently preferably, a thin, long flat member 94 having a hook portion 116 at one end and a v shaped two leg member 96, with each of the legs 106, 108 having a flange 102, 104 for engaging the surface 78 of the planar member 52 at the other end. The portion between the two legs 106, 108 and the hook end 116 is, presently preferably, about three (3.0)inches long, about 0.018 inch thick and about 0.37 inch wide. In any event, the length of the flat member 94 should be sufficient to cover any thickness of planar member 52 or ceiling likely to be encountered.

As illustrated in FIG. 7, the two legs 106, 108 are positioned at about, presently preferably, sixty (60°) degrees with respect to each other. Connected to each leg 106, 108 presently preferably, at about a ninety five (95°) degree angle therewith are the flanges 102, 104, which are about 0.14 inch wide and about 0.625 inch long. These flanges 102, 104 are the part of the mounting strap 40 which contact the inner surface 78 (see FIG. 14) of the planar member 52 and distribute the weight of the remodeler light fixture such that the structural integrity of the material of the planar member 52 is not penetrated or broken down by the weight of the fixture. In short, the flanges 102, 104 distribute the weight of the light fixture over a larger surface area of the planar member 52 than those of the prior art thereby avoiding complete reliance on the structural integrity of the planar material, such as, for example, how thick or how thin the planar member 52 is at any given point, for bearing the full weight of the light fixture at only a few sharp points of contact. The ninety five (95°) degree angle between the legs and the flanges provide a tighter, more secure installation.

Additionally, these flanges 102, 104 are the components which either dig into the planar member 52 or raise off the planar member 52 during attempted rotation of the support structure 20 when an installer attempts to rotate the support structure 20, as will be described below. It should be understood that dimensions of the flanges 102, 104 can vary and that the flanges illustrated were developed to meet a specific physical test of installation.

The angle of the connection between each leg 106, 108 and the long flat member 94 should be greater than about ninety (90°) degrees because of the potential that the mounting strap will slide away from the planar material when the mounting strap is pulled down into contact with the planar member. The angle of the connection between each leg 106, 108 and the respective flange 102, 104 should preferably be about ninety (90°) degrees but less than about one hundred seventy (170°) degrees because the closer the angle between the leg and the flange is to one hundred eighty (180°) degrees, the smaller the surface area of the flange contacting the planar member for distributing the weight of the fixture.

Figure 13:
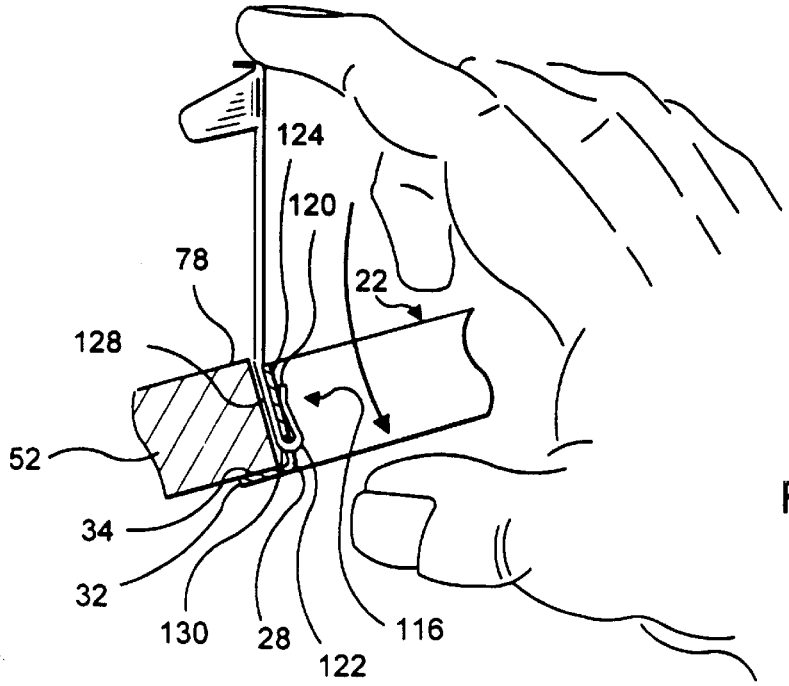

The hook portion 116 of the mounting strap 40 is designed for holding the mounting straps 40 in a specific position in the perimeter member 22 after leaving the factory and before the support structure 20 is installed in an aperture 74 in a planar member 52. As illustrated in FIGS. 1 and 13, when the mounting straps 40 are initially located in the slots 24, 26, 28 of the perimeter member 22, the inner surface 120 of the hook portion 116 is in contact with the inner surface 122 of the perimeter member 22 and the inner surface 124 of the mounting strap flat member 94 is contiguous with the outer surface 128 of the perimeter member 22 with the connecting portion 130 of the hook 116 being pulled contiguous with the portion of the mounting strap slots 24, 26, 28 placed therebetween. After assembling in this manner, the mounting straps 40 can be bent into position and nested in the center of the perimeter member 22. In this nested position, a plurality of light fixture support structures 20 can be efficiently packaged for shipment and distribution to end users.

One important element of the present invention is the light fixture support structure retaining means or mounting strap 40 which, when properly positioned in the, at least two and preferably three, slots 24, 26, 28 formed in the perimeter member 22 of the support structure 20, provides for the distribution of the weight of the installed lighting fixture such that the structural integrity of the planar member 52 is maintained. The mounting straps 40 include means for distributing the weight of the support structure 20 over a larger surface area of the surface 78 of the planar member 52 than those of the prior art and, thus, allows the lighting fixture to be installed in planar members having less than optimal structural integrity such as, for example, ceiling tile.

As shown in FIG. 8, in addition to distributing the weight of the lighting fixture or trim 50 over the surface 78 of the planar member 52, the mounting strap 40 of the present invention is designed to prevent the support structure 20 from rotating in the planar member 52. Specifically, it is undesirable to have the support structure 20 rotate in the aperture 74 in the planar member 52 when installing the trim or when installing incandescent light bulbs, etc. Therefore, the surface 100 of the mounting strap flange 102, 104 in contact with the planar member 52 "digs into" the surface 78 of the planar member 52 that they contact whenever there is an attempt to rotate the support structure 20 positioned inside the aperture 74 of the planar member 52. When attempting to rotate the support structure 20, one of the legs 106, 108 of at least one of the preferably three mounting straps 40 digs into the planar member 52. Specifically, the forward leg in the direction of rotation "digs in" while the rear leg is slightly raised into the air above the surface 78 of the planar member 52 during attempted rotation.

As shown in FIGS. 9, 10, 15–17 and 19, a unique junction box 72 and the associated socket 88, useful with the systems apparatus and methods of the present invention includes a base plate 84 having a tab or tongue 92 operatively connected thereto. The base plate 84 has the tab or tongue 92 at one end 130 and the unique junction box 72 including the thermal probe 76 at the other end 110. The tab 92 is connected at the end 130 of the base plate 84 most remote from the junction box 72. At the end 130 most remote from the junction box 72, the base plate 84 has an arched portion 132 with, presently preferred, two feet 140, 142, formed at the end thereof. The feet 140, 142 are formed respectively at each end of the arched portion 132 and at about a ninety degree (90°) angle with the plane of the base plate 84. The feet 140, 142 are for interacting with the aperture 74 formed in the planar member 52 and cooperating with the base plate 84 and the tab 92 to insure that the junction box 72 when connected to the support structure 20, perimeter member 22 and with the feet in the aperture 74, is accurately positioned relative the aperture 74 such that all applicable regulations and codes are met (see FIGS. 16–18). The feet 140, 142 and the tab 92 combine to prevent the base plate 84 from changing locations/positions on the surface 78 of the planar member 52 (ceiling) once installed, therefore insuring that the junction box 72 remains in the installed position.

Figure 19:
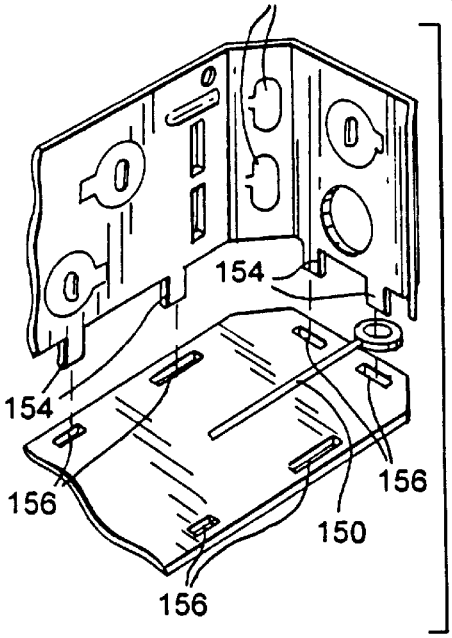
FIG. 19 is a partial perspective view of the sidewalls and the baseplate assembly of the junction box of FIGS. 9 and 10 according to the present invention.

The new unique eight sided (including an access door or cover 146 when closed) junction box 72 is specially constructed with minimal gauge material. The junction box has a specifically designed access door 146 and a grounding wire 150 (see FIG. 19) which is uniquely attached to the box 72. An integral electrical cable clamp 152 operatively positioned inside the junction box requires no tools for electrical capable attachment thereto while being able to pass requisite testing. Specifically, the internal volume of the junction box is about twenty-one (21) cubic inches. This internal volume is believed to be the optimum size for accommodating the number of electrical wires allowed to be inside a junction box of this type by code and regulation. The construction of the unique junction box includes optimization of the location of the thermal probe 76 and the incoming electrical wire and the strategic orientation of the flexible conduct to minimize the junction box's dimension so that the entire junction box can be installed into a 3¾ inch diameter aperture. The complete junction box assembly is accomplished without hardware, such as, for example, screws, rivets or other hardware. Specifically, as shown in FIG. 19, a plurality of tabs 154 and a plurality of slots 156 slots (tab and slot construction) are utilized along with a snap and lock hinged door 146. The junction box 72 provides optimal wiring and volume and is capable of being passed through a 3¾ inch diameter opening in a building surface or planar member.

As shown, the junction box of the present application is constructed of a minimal gauge material. In particular, the eight sided junction box of the present application is configured such that the interior space is optimized for both interior volume and for installation through an aperture in a planar member approximately 3¾ inches in diameter, as mentioned above. The door 146 to the junction box is hinged at 158 and is captive. The door when opened swings open and holds its open position without fasteners for easy access when connecting wiring within the junction box.

Another feature of the junction box concerns the connection of the ground wire 150 to the junction box during the junction box assembly process by placing the ground wire between a tab 154 of the eight sided wall member and between a slot 156 in the junction box plate 84 so that the ground wire 150 is securely connected to the junction box 72 (see FIG. 19). Access for nonmetallic sheathed cable (Romex) is through the hinged door versus a knockout detail of the prior junction boxes. During the connection of the cable, the hinged knockout 160 remains intact versus the knockout slug of the prior junction boxes and does not require any tools in order to open whereas the prior art required tools to pry open the knockout.

Finally, the cable clamp 152 hinged to the wall of the junction box in combination with the access hole 160 size in the wall of the junction box provides for fast and easy insertion of the sheathed cable and automatically adjusts for 12–14 gauge NM sheathed cable. Further, the cable clamp 152 enables the junction box to resist UL's 50 lb. pull test in one motion without having to use tools or having to perform a secondary action to clamp or fasten the sheathed cable. Specifically, the cable clamp is structured such that once the cable is inserted through a slot 162 in the clamp 152 and an attempt is made to pull the cable back out of the junction box, the cable clamp 152 pivots about the hinge thereby compressing the cable between the opposing sides of the slot 162 in the clamp 152 (strain relief feature).

When connecting wire(s) to the junction box, with the 1100 and 1000 series remodelers, the junction box can be hung temporarily from the perimeter member to assist with the wire connections. When connecting wire(s) to the junction box, an open hinged knockout 160 is opened and a wire, preferably non-metallic sheathed cable, is pushed through the knockout opening 160 and through the cable clamp 152.

Figure 14:
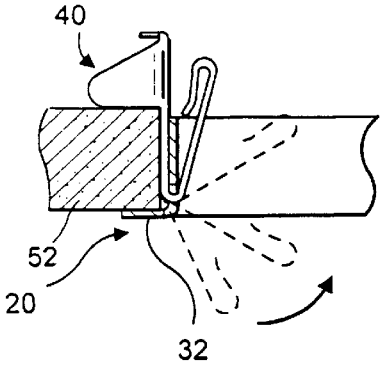

FIGS. 12–18 illustrate one method for installing a light fixture in existing construction using the illustrated circular light fixture support structure 20. First, an aperture 74 is cut in the planar member 52 at the desired location utilizing the template 90, as described above. Once the aperture 74 in the planar member 52 has been completed, the assembled support structure 20, including the preferred three mounting straps 40 and the trim springs 42, 44, 46, is inserted into the aperture 74. The light fixture installer holds the support structure 20 in position in the aperture 74, reaches in and pushes down on the mounting straps 40 (FIG. 13), preferably, one at a time until each mounting strap 40 contacts the inner surface 78 of the planar member 52 such that the planar member 52 is sandwiched between the mounting straps 40 and the inner surface 34 of the lip portion 32 of the perimeter member 22. As shown in FIG. 14, once each mounting strap 40 is in contact with the inner surface 78 of the planar member 52, the light fixture installer bends the mounting straps 40 and secures the support structure 20 in position in the aperture 74 effectively clamping the planar member 52 between the lip portion 32 of the perimeter member 22 and the retaining means or mounting strap 40.

Figure 15:
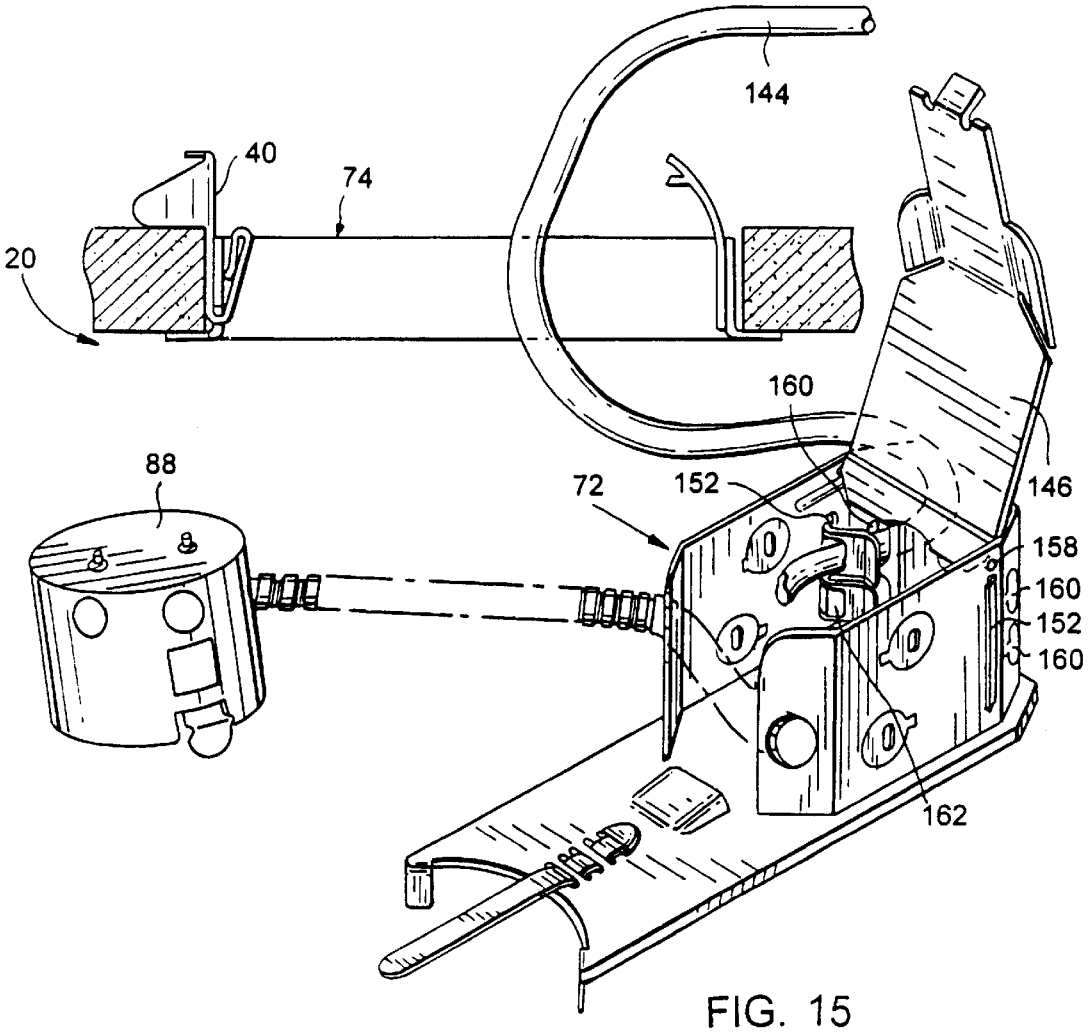

At this point, it should be understood that, due to the flexibility of the system and methods of the present invention, it is possible to install the support structure 20 either before or after the wiring has been installed. Specifically, as shown in FIG. 15, conventional electrical wire 144 to be connected to the junction box 72. This particular connection, as mentioned above, could be accomplished by an electrician before the light fixtures support structure 20 is placed in the aperture 74 in the planar member 52 or it could be accomplished after the light fixtures support structure 20 is placed in the aperture, as will now be discussed.

Figure 17:
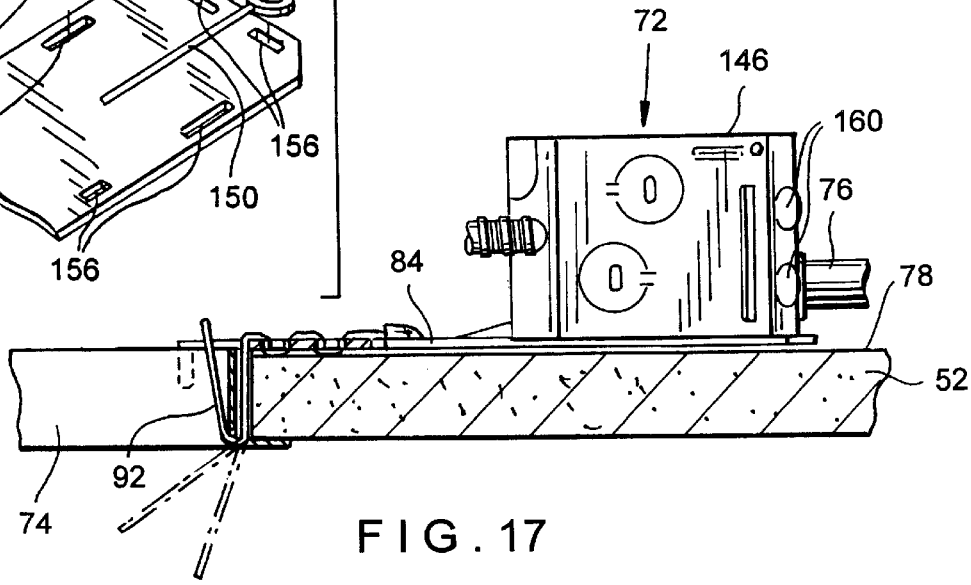

Once the junction box 72 and the connected socket 88 are connected to the electrical wiring 144 and the support structure 20 has been installed in the aperture 74, the junction box tab or tongue 92 is inserted through the most narrow slot 70 in the perimeter member 22 marked, "junction box", between the planar member 52 and the perimeter member 22 and pulled into position such that the interior surface of each foot 140, 142 of the junction box base plate 84 is properly inserted into the aperture 74 contiguous with the cut edge of the planar member 52, as shown in FIGS. 16 and 17. Once the junction box 72 is properly positioned, the junction box tab 92 is inserted through the narrow slot 70 and pulled down until the junction box plate 84 sits flat on the interior surface of the planar member 52. Then, the tab 92 is bent upward securing the junction box 72 into proper position, as shown in FIG. 17.

Figure 18:
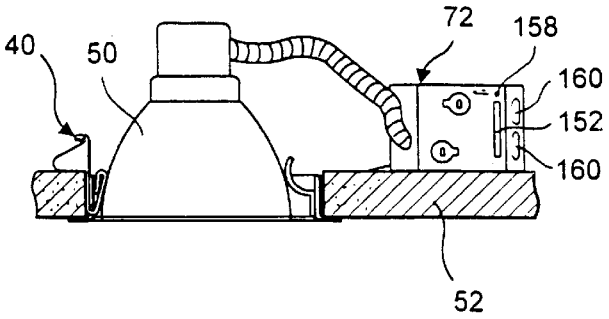

As shown in FIG. 18, after the junction box 72 has been secured to the support structure 20, thereby automatically repeatedly, consistently and predictably positioning the junction box 72 to meet Underwriters Laboratory and code requirements, the socket 88 is attached thereto, as is known in the art, and the trim 50 or the light fixture is then positioned inside the support structure 20.

As mentioned in the background of the invention, no known previous remodeler light fixture support structures had the capability of ready installation into variable thickness planar members and had the capability of being installed in planar members having less than ideal structural integrity or structural capability.

Thus, it can be seen that all objectives of the present invention have been met. Specifically, the present invention provides: an improved remodeler support structure for a light fixture installed in planar surfaces; an improved system and apparatus wherein the electrical and the mechanical elements are separated; means, operatively positioned in the support structure, for sandwiching a planar member of an infinite thickness; means, operatively positioned in the support structure, for securing the support structure which accepts finishing trim; improved methods, systems and apparatuses for consistently and repeatedly positioning a junction box relative to the aperture; improved methods, systems and apparatuses for securing the junction in place once accurately located relative to the aperture and methods and apparatuses for marking the position in the planar member where the aperture is to be cut and guides the installer in cutting the aperture.

Changes and modifications in the specifically described embodiments can be carried out without departing from the scope of the invention which is intended to be limited only by the scope of the appended claims.

What is claimed is:

1. A system for supporting a light fixture in an aperture formed in a planar member having a certain thickness, the system comprising:

a light fixture support structure including a perimeter member having a wall portion and a lip portion protruding outwardly from said wall portion; and retaining means operatively secured to said perimeter member for engaging the upper surface of the planar member and for retaining said light fixture support structure in position in the planar member, said retaining means comprising means for clamping said planar member between said lip portion of said perimeter member and said retaining means.

2. The system of claim 1 wherein the inner surface of the lip is held approximately contiguous with the lower surface of the planar member.

3. The system of claim 1 wherein the perimeter member further comprises:

at least two slots formed at the junction of the wall and the lip.

4. The system of claim 3 wherein the retaining means comprises:

a mounting strap having a hook member at one end and a v shaped two leg member at the other end, each of the legs having a flange member for engaging the surface of the planar member when inserted through a slot in the perimeter member.

5. The system of claim 4 further comprising:

an electrical junction box having a base plate including means for operatively connecting the base plate to the aperture and a tab operatively connected to the base plate; and means, operatively formed in the perimeter member, for operatively connecting the junction box to the light fixture support structure.

6. The system of claim 5 further comprising:

means, operatively connected to the junction box base plate, for positioning the electrical junction box relative the inner surface of the planar member at a predetermined distance from the aperture.

7. The system of claim 6 wherein the tab securely attaches the junction box to the light fixture support structure.

8. The system of claim 7 wherein the junction box is operatively connected to the light fixture support structure such that the junction box is positioned on the inner surface of the planar member proximal the light fixture support structure and at a predetermined distance therefrom.

9. A light fixture support structure comprising:

a perimeter member having a wall portion and a lip portion protruding outwardly from said wall portion, a plurality of slots formed in said wall portion; and retaining means operatively positioned in said slots and secured to said perimeter member for retaining the light fixture support structure in position in an aperture formed in a planar member, said retaining means including means for clamping the planar member between said lip portion and said retaining means.

10. The support structure of claim 9 wherein the retaining means comprises:

a mounting strap having a hook member at one end and a v shaped two leg member at the other end, each of the legs having a flange member for engaging the surface of the planar member.

11. The support structure of claim 9 further comprising:

means, operatively positioned around the interior periphery of the perimeter member, for maintaining trim installed in the support structure in proper position.

12. The support structure of claim 11 wherein the trim maintaining means further comprises:

a plurality of trim springs.

13. The support structure of claim 12 wherein the trim maintaining means further comprises:

a plurality of slots and a plurality of apertures, the slots and the apertures cooperating to support the trim springs and to allow the trim springs to support any trim installed in the support structure.

14. The support structure of claim 10 wherein, when rotational force is applied to the support structure, the flange members prevent rotation of the support structure in the aperture in the planar member.

15. A mounting strap for securing a light fixture support structure to an aperture formed in a planar member, the mounting strap comprising:

an elongated, planar member having a hook portion at one end and a v shaped two leg member at the other end, each of the leg members having flanges, for distributing the weight of a light fixture such that the structural integrity of the planar member is maintained, operatively connected thereto.

16. The mounting strap of claim 15 wherein the two legs of the v shaped two leg member are positioned at about a sixty (60°) degree angle with respect to each other.

17. The mounting strap of claim 15 wherein each flange is operatively connected to the leg at about a ninety five (95°) degree angle therewith.

18. A light fixture system for installation in an aperture formed in a planar member of a certain thickness having an inner and an outer surface, the system comprising:

a light fixture support structure including a perimeter member having a wall portion and a lip portion having an inner and outer surface, said lip portion protruding outwardly from said wall portion;

retaining means operatively connected to said perimeter member for retaining said light fixture support structure in position in the planar member, said retaining means including means for clamping the planar member between said lip portion of said perimeter member and said retaining means;

a junction box having a tab operatively connected thereto; and means formed in said perimeter member for receiving said junction box tab such that the junction box is positioned on the inner surface of the planar member proximal the light fixture support structure and at a predetermined distance therefrom.

19. The system of claim 18 wherein the electrical junction box includes an extended base plate and the tab is operatively connected to the end of the base plate most remote from the junction box.

20. A method of installing a light fixture in a planar member having an inner and an outer surface, the method comprising the steps of:

cutting an aperture in the planar member at the point where the lighting fixture is to be installed;

providing a light fixture support structure having a perimeter member and a peripheral lip having an inner and an outer surface;

providing at least two retaining means operatively attached to and positioned at predetermined locations about the perimeter of the light fixture support structure for retaining the light fixture support structure in position in an aperture formed in the planar member;

positioning the light fixture support structure in the aperture;

positioning said at least two retaining means contiguous with the inner surface of the planar member; and manipulating said at least two retaining means such that the light fixture support structure is maintained in position in the aperture by clamping the planar member between said lip portion of said perimeter member and said retaining means.

21. The method of claim 20 further comprising the step of:

providing an electrical junction box having a base plate including means for operatively connecting the base plate to the aperture and a tab operatively connected to the base plate.

22. The method of claim 21 further comprising the step of:

after the aperture cutting step and before the light fixture support providing step, operatively connecting electrical wiring to the electrical junction box.

23. The method of claim 22 further comprising the step of:

operatively positioning the electrical junction box on the inner surface of the planar member proximal the aperture.

24. The method of claim 20 further comprising the step of:

after the light fixture support positioning step, operatively connecting electrical wiring to the electrical junction box.

25. The method of claim 24 further comprising the step of:

operatively positioning the electrical junction box on the inner surface of the planar member proximal the aperture.

26. The method of claim 25 further comprising the step of:

operatively connecting the electrical junction box having the tab to the light fixture support structure.

27. The method of claim 26 further comprising the step of:

operatively securing the junction box to the light fixture support structure and the planar member such that the junction box is secured in position on the inner surface of the planar member proximal the light fixture support structure.

28. The method of claim 27 wherein the junction box securing step further comprises the step of:

bending the tab such that the tab and the light fixture support structure are interconnected.

29. The method of claim 20 wherein during the manipulating step, the inner surface of the lip is held approximately contiguous with the lower surface of the planar member.

30. A junction box for use with a remodeler support structure installed in a plurality of possible apertures in an existing construction, the junction box comprising:

side walls;

a top wall;

a front wall contiguous with said top wall and a rear wall, said rear wall including means for housing a thermal probe; and a planar base plate having a top and a bottom surface and having a front portion and a rear portion, said planar base plate being operatively connected to said side, top, front and rear walls, said front portion extending beyond said front wall for a predetermined distance, the end of said front portion most remote from said front wall having at least two feet, one on each side of the end of said front portion, said at least two feet interacting with an aperture such that the junction box can be positioned at said predetermined distance from any one of a plurality of possible apertures.

31. The junction box of claim 30 wherein the feet extend downwardly from the bottom surface of the planar base plate at about a ninety degree (90°) angle therewith.

32. The junction box of claim 31, further comprising:

an arch formed in said planar base plate front portion connecting said at least two feet.

33. The junction box of claim 30 further comprising:

a tab, operatively connected to the base plate front portion, for connecting the junction box to the support structure.

34. Apparatus for installing a light fixture in an aperture formed in a planar surface member such as a ceiling or the like, said apparatus comprising a support member having a wall structure and a peripheral flange laterally extending from said wall structure, a plurality of retaining means movably secured at their lower ends within a corresponding plurality of slots formed in said wall portion, each of said retaining means including an upper end adapted to engage one surface of the planar surface and a lower end passing through said slot, each of said retaining means being movable within its associated slot into a position in which the surface member is clamped between said peripheral flange and the upper engaging end of said retaining means.

35. The apparatus of claim 34, in which the lower end of each of said retaining means include resilient means adapted to engage and retain the surface of a lighting fixture when the upper end of said retaining means is moved into is engagement with the planar surface.

36. The apparatus of claim 35, in which said plurality of slots and associated plurality of retaining means are substantially equiangularly arranged along the lower end of said wall structure.

37. The apparatus of claim 36, further comprising a plurality of resilient retention members having their lower ends secured to the lower end of said wall structure and their upper free ends adapted to engage the lamp fixture when said apparatus is in clamping engagement with the planar surface member.

38. The apparatus of claim 37, in which said retention members are substantially angularly spaced along said wall structure and angularly spaced from said plurality of retaining means.

39. The apparatus of claim 34, in which said plurality of slots and associated plurality of retaining means are substantially equiangularly arranged along the lower end of said wall structure.

40. The apparatus of claim 39, further comprising a plurality of resilient retention members having their lower ends secured to the lower end of said wall structure and their upper free ends adapted to engage a lamp fixture when said apparatus is in clamping engagement with the planar surface member.

41. The apparatus of claim 40, in which said retention members are substantially equiangularly spaced along said wall structure and angularly spaced from said plurality of retaining means.

42. The apparatus of claim 34, further comprising a plurality of resilient retention members having their lower ends secured to the lower end of said wall structure and their upper free ends adapted to engage a lamp fixture when said apparatus is in clamping engagement with the planar surface member.

43. The apparatus of claim 42, in which said retention members are substantially equiangularly spaced along said wall structure and angularly spaced from said plurality of retaining means.

* * * * *